US007008248B2

(12) United States Patent
Kondas et al.

(10) Patent No.: US 7,008,248 B2
(45) Date of Patent: Mar. 7, 2006

(54) JUMPER WITH INTEGRAL RECEPTACLE BRACKET

(75) Inventors: Shawn J. Kondas, Kendallville, IN (US); Daniel L. Hayes, Kendallville, IN (US)

(73) Assignee: Pent Technologies, Inc., Kendallville, IN (US)

( * ) Notice: Subject to any disclaimer, the term of this patent is extended or adjusted under 35 U.S.C. 154(b) by 0 days.

(21) Appl. No.: 10/845,695

(22) Filed: May 14, 2004

(65) Prior Publication Data

US 2005/0009393 A1 Jan. 13, 2005

Related U.S. Application Data

(60) Provisional application No. 60/470,560, filed on May 14, 2003.

(51) Int. Cl.
*H01R 4/60* (2006.01)

(52) U.S. Cl. ..... 439/211; 439/654; 439/540.1

(58) Field of Classification Search ..... 439/207–211, 439/215, 216, 533, 110, 121, 527, 529, 654, 439/532, 540.1, 594; 248/68.1, 228.1, 228.5, 248/228.7

See application file for complete search history.

(56) References Cited

U.S. PATENT DOCUMENTS 5,096,433 A 3/1992 Boundy ..... 439/215
5,112,240 A * 5/1992 Nienhuis et al. ..... 439/215
5,131,860 A * 7/1992 Bogiel ..... 439/215
5,158,472 A 10/1992 Juhlin ..... 439/215
5,178,555 A * 1/1993 Kilpatrick et al. ..... 439/215
5,186,640 A 2/1993 McCoy ..... 439/211
5,349,135 A * 9/1994 Mollenkopf et al. ..... 174/48
5,412,529 A * 5/1995 Eaton et al. ..... 361/90
5,562,469 A 10/1996 Nienhuis et al. ..... 439/275
5,728,970 A 3/1998 Karst et al. ..... 174/48
6,139,360 A 10/2000 Hayashi et al. ..... 439/502
6,402,536 B1 6/2002 Tsukamoto et al. ..... 439/211
6,835,081 B1 * 12/2004 Plattner et al. ..... 439/215
2002/0052133 A1 5/2002 Henriott et al. ..... 439/215

* cited by examiner

*Primary Examiner*—Tho D. Ta
(74) *Attorney, Agent, or Firm*—Taylor & Aust, P.C.

(57) ABSTRACT

A power distribution jumper assembly includes a relatively fixed rigid support member, a multi conductor cable for supplying electrical energy to power utilization equipment and an electrical connector at one cable end. There is a jumper bracket mechanically coupled to the support member which mechanically supports the cable end and corresponding connector. A multiport electrical power distribution block receives the electrical connector. An electrical component is electrically connected to the power distribution block. The jumper mounting bracket extends from the support member and is mechanically connected to and rigidly supports the electrical component, connector and cable end.

20 Claims, 2 Drawing Sheets

JUMPER WITH INTEGRAL RECEPTACLE BRACKET

CROSS REFERENCE TO RELATED APPLICATIONS

This application claims the benefit of U.S. Provisional Patent Application No. 60/470,560, filed May 14, 2003, and entitled MODULAR ELECTRICAL DISTRIBUTION SYSTEM IN A MODULAR WALL PANEL ASSEMBLY.

Other related applications include U.S. patent application Ser. No. 10/845,678, filed on even date herewith, entitled SYSTEM TO PLACE RECEPTACLES AND DISTRIBUTION BLOCKS, and U.S. patent application Ser. No. 10/846,088, filed on even date herewith, entitled DOUBLE "E" ELECTRICAL DISTRIBUTION BLOCK, the entire disclosures of which are specifically incorporated herein by reference.

BACKGROUND OF THE INVENTION

1. Field of the Invention

The present invention relates to power distribution systems and more particularly to a power distribution assembly for supplying power to a plurality of spaced apart work stations, for example, as found in a modular furniture environment. Such modular electrical distribution systems are frequently used in wall panel assemblies within an office environment.

2. Description of the Related Art

Wall panel power distribution systems are typically located near a panel upper or lower edge and within a metal channel or wireway. Conventionally, an electrical distribution wiring harness has an extruded metal wire channel extending from a center block, and the receptacle brackets are attached directly to the metal wire channel which is rigidly and permanently mounted to the center block. The jumper cables which interconnect terminal blocks are either permanently wired to the terminal blocks or coupled thereto by jumper connectors. The jumper connectors rely on the terminal block for mechanical support as do electrical receptacles which may be electrically connected to certain terminal blocks.

SUMMARY OF THE INVENTION

The present invention provides a unique power distribution jumper cable assembly and method of assembling a power distribution jumper cable assembly.

The invention comprises, in one form thereof, a power distribution jumper assembly having a flexible multi conductor cable for supplying electrical energy to power utilization equipment with an electrical connector at one cable end. There are a plurality of electrical contacts within the connector, certain ones of which connect to corresponding cable conductors. A bracket mechanically engages the cable connector for directly supporting the cable end and corresponding connector. An electrical component is electrically coupled to the electrical connector. The bracket includes a component retainer for providing support to the electrical component.

In another form, a power distribution jumper assembly mounting bracket has a central jumper grasping portion and opposed pairs of modular electrical component retaining tabs. One pair of tabs extends outwardly from one side of the central jumper grasping portion and the other pair extends outwardly from an opposite side of the central jumper grasping portion for spanning and mechanically securing respective electrical components. Each side of the central jumper grasping portion further includes a resilient biasing portion for engaging and urging the corresponding electrical component outwardly away from the bracket to facilitate removal of the electrical component.

In a still further form, a method of assembling and stabilizing a power distribution system on a support member includes fixing a jumper mounting bracket to a jumper cable near one end thereof, fastening a power distribution block to the support member, electrically coupling the jumper cable one end and the power distribution block and attaching the jumper mounting bracket to the support member. A modular electrical component is electrically connected to the power distribution block and mechanically connected to the jumper mounting bracket.

An advantage of the present invention is that methods for mounting receptacles and power entry connectors are simplified.

Another advantage of the present invention is that flexible jumpers having connectors on opposite ends allow ease of panel-to-panel connecting.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
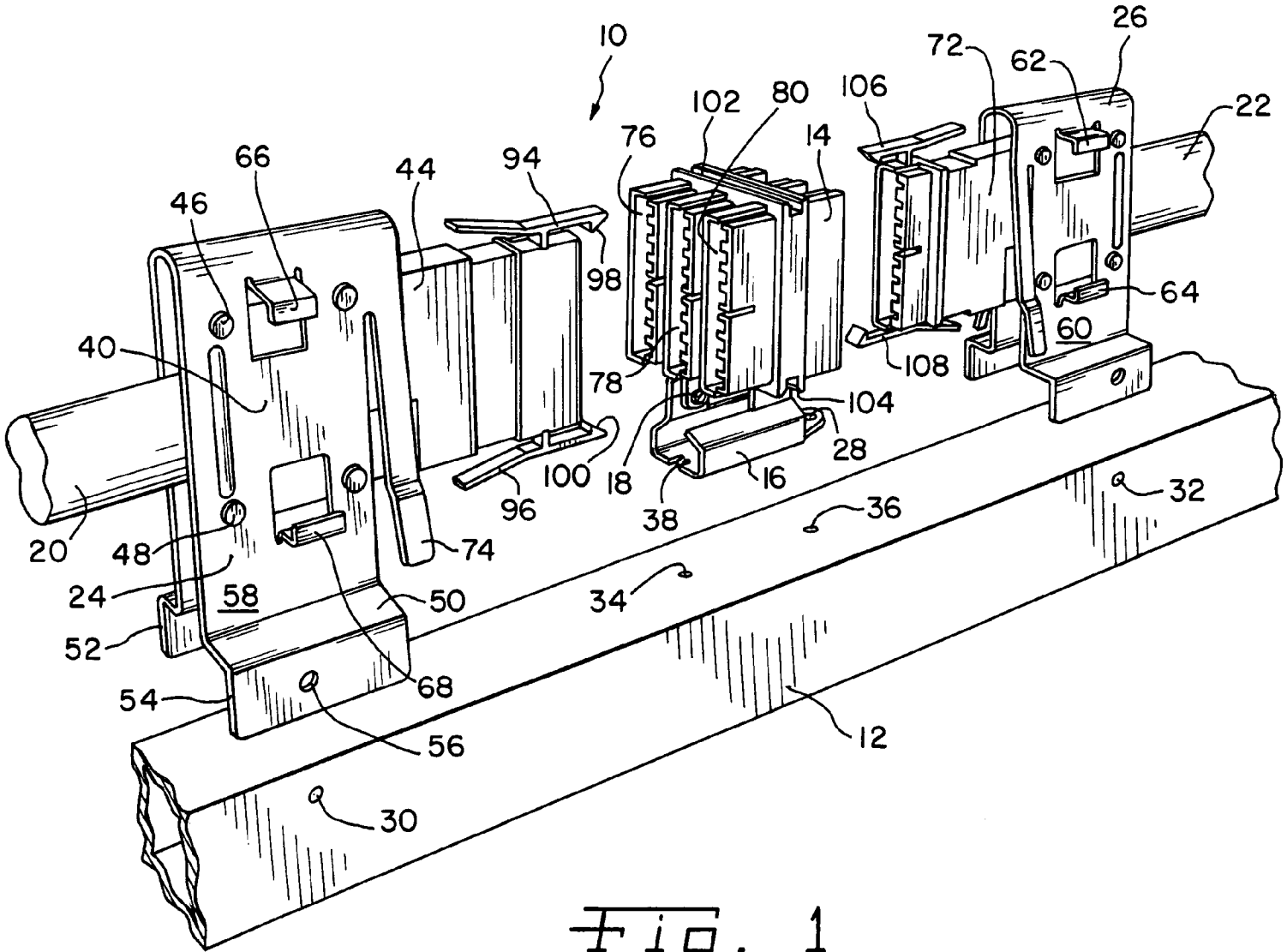
FIG. 1 is an isometric view of a certain components of a power distribution assembly.
Figure 2:
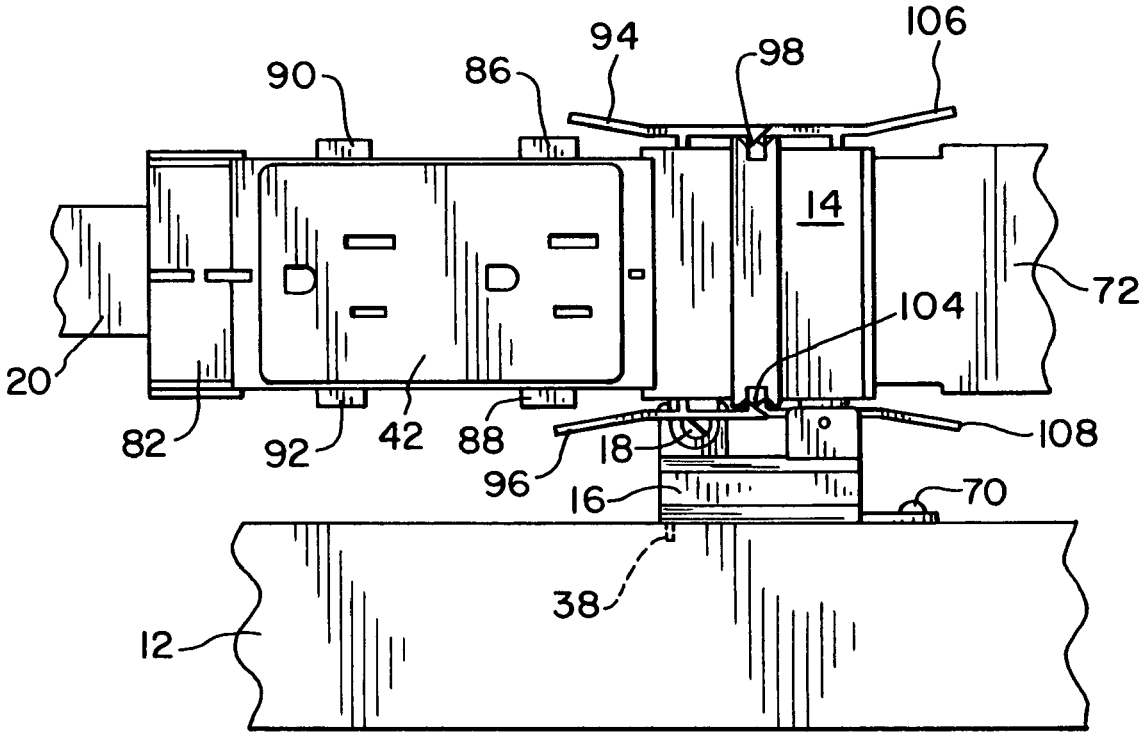
FIG. 2 is a side elevation view of a modified portion of FIG. 1.

Referring now to FIG. 1, there is shown a plurality of power distribution components of a power distribution assembly 10 aligned and ready to be joined. The embodiment illustrated shows a modular electrical distribution system 10 of the present invention, which includes a multiport power distribution block 14, jumper cables 20 and 22, cable/receptacle mounting brackets 24 and 26, and may include additional electrical components such as electrical receptacles (FIG. 2). A rigid support member 12 awaits the multiport power distribution block 14 to be joined by block mounting bracket 16. The block mounting bracket 16 and distribution block 14 may be joined by threaded fasteners such as screw 18, or may be coupled in a snap latch manner. Configured with a snap latch arrangement, multi-port power distribution block 14 may be coupled with the mounting bracket without the use of tools. Mounting bracket 16 is coupled with fixed structure 12 using any suitable fastening technique, such as with a screw 70 (FIG. 2) passing through a threaded fastener receiving aperture 28 in the bracket base and into the aperture 36 in support 12. Alternatively, fixed structure 12 may include mounting details allowing multiport power distribution block 14 to be directly coupled therewith, rather than using an intervening mounting bracket such as 16. As shown in FIG. 1, support member 12 includes predrilled holes 30, 32, 34 and 36 properly spaced and aligned as by a template. The hole or aperture 34 receives support member engaging tab 38 while aperture 36 receives screw 70 passing through the bracket base. The engagement of tab 38 prevents swiveling of the bracket 16 about the single screw 70. Other suitable mounting techniques may, of course, be employed.

Holes 30 and 32 are positioned to receive screws which provide attachment by way of component mounting brackets 24 and 26 of power distribution jumper portions of the assembly 10. Mounting bracket 24, for example, functions to support cable 20 and its associated electrical connector 44 and provides mechanical support for an electrical component such as a duplex receptacle. Cable/receptacle mounting brackets (also called jumper brackets) 24 and 26 thus provide a dual functionality of maintaining jumper cables 20 and 22 in place with multi-port power distribution block 14, and also mechanically supporting an electrical receptacle such as 42 (FIG. 2) which is plugged into multiport power distribution block 14.

The jumper bracket 24 is formed by bending a single sheet of metal into a U-shape which surrounds the jumper connector 44 with the free U ends flared outwardly and downwardly (as viewed). Thus, there is formed a central connector grasping portion 40 which is fixed to the connector 44 by rivets such as 46 and 48. Bracket 44 also includes a base portion 50 comprising a pair of flanges 52 and 54 for spanning the fixed structure 12. Each flange has a fastener receiving aperture such as 56 which, when the bracket is positioned on support 12, allows a screw to pass through the flange and into an aperture such as 30 thereby securing the jumper bracket to the fixed structure.

Bracket 44 also includes a component retainer on each on each of the opposed sides. This retainer is visible on the bracket sides 58 and 60. Each retainer has a pair of modular electrical component clamping or retaining tabs 62, 64, 66 and 68 which extend outwardly from a connector grasping portion side 58 or 60. Pairs of opposed tabs are designed to engage a corresponding pair of tabs or grooves on an electrical component as shown in FIG. 2. Each jumper bracket further includes a second pair of modular electrical component retaining tabs extending outwardly from a connector grasping portion side opposite the side visible in FIG. 1 for similarly spanning and mechanically securing a further electrical component. In the embodiment shown in FIG. 2, electrical receptacle 42 is snapped into engagement with cable/receptacle mounting bracket without the use of tools. A spring bias tab 74 engages the back of electrical receptacle 42 urging that receptacle firmly against the mounting tabs 66 and 68 providing a rigid mounting during normal use, and further aids in removal of the receptacle when the mounting tabs are sprung outwardly to release the receptacle. Alternatively, an electrical receptacle may be screw mounted or otherwise fastened to a corresponding cable/receptacle mounting bracket, depending upon the particular application.

In FIG. 2, the power distribution block 14 has been joined with the block mounting bracket 16 and that bracket fastened to the support 12 by screw 70. Distribution block 14 is illustrated as having six like connector ports, three of which, 76, 78, and 80, are visible in FIG. 1. The jumper cable connector 44 is shown in FIG. 2 mated with the central distribution block port 78 and connector 72 is similarly mated with the central port opposite port 78. Jumper cable mounting brackets 24 and 26 have been omitted, however, it will be understood that mounting bracket 24 would normally lie behind the receptacle 42. Receptacle 42 has connectors such as 82 at opposite ends which mate with any of the distribution block ports. Receptacle 42 is shown electrically connected or mated with the distribution block 14 port 80. The mechanical connection of receptacle 42 to bracket 24 is by the clamping or retaining tabs 66 and 68 which span the receptacle vertically as viewed, and engage an opposed pair of receptacle ears 86 and 88. Ears 90 and 92 are not used in the illustration, but would be spanned and gripped by tabs 62 and 64 had connector end 82 been mated with, for example, the distribution block port facing away from port 80.

The jumper cable connectors 44 and 72 are designed to mate electrically with corresponding ports in distribution block 14 as shown in FIG. 2. Each connector can be mated with any unoccupied one of the ports, but preferable mate with the center ports such as 78 to allow free access, for example, by duplex receptacles, to the outside ports such as 76 and 80. When a connector and port are mated, resilient arms 94 and 96 or 106, 108 flex allowing hooks such as 98 and 100 to engage a pair of opposed transverse block grooves 102 and 104 to create a latched arrangement securing the junction between the connector and port.

Assembling the system includes fixing jumper mounting bracket 24 or 26 to a jumper cable 20 or 22 near one end of the jumper cable. This may be accomplished by riveting or otherwise joining the one-piece bracket 24 or 26 to the connector, by employing rivets, screws, or similar fasteners in conjunction with a two piece bracket similar to the bracket illustrated, but with the overlying U-shaped bracket portion omitted, or even by integrally molding one or more bracket members in the insulative portion of the connector. Power distribution block 14 is mechanically fastened to the support member 12, for example, by bracket 16. and electrically coupled to a jumper cable end. The jumper mounting bracket is attached to the support member 12. A modular electrical component such as electrical receptacle 42 is electrically connected to the power distribution block and the modular electrical component is mechanically connected to the jumper mounting bracket thereby stabilizing the power distribution system on the support member.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

PARTS LIST

10 power distribution jumper assembly
12 fixed structure or support member, e.g., wall panel frame or other rigid support
14 multiport electrical power distribution block
16 block mounting bracket
18, 70 threaded fastener (screw)
20, 22 flexible multi conductor cable, or jumper cable
24, 26 support or mounting bracket, or component mounting bracket
28, 56 threaded fastener receiving aperture
30, 32, 34, 36 support member mounting holes
38 support member engaging tab

40 connector or jumper grasping portion
42 receptacle
44, 72 connector
46, 48 rivets
50 base portion
52, 54 structure spanning flanges
58, 60 bracket sides
62, 64, 66, 68 clamping or retaining tabs
74 spring bias tab
76, 78, 80 connector port
84 receptacle end connector
86, 88, 90, 92 receptacle ears
94, 96, 106, 108 resilient arms
98, 100 hook near free arm end
102, 104 transverse hook accepting grooves

What is claimed is:

1. A power distribution jumper assembly including a flexible multi conductor cable for supplying electrical energy to power utilization equipment, an electrical connector at one cable end having a plurality of electrical contacts certain ones of which connect to corresponding cable conductors, a bracket mechanically engaging the cable connector and said multi conductor cable near said one cable end for directly supporting the cable end and corresponding connector, an electrical component electrically coupled to the electrical connector, and another bracket including a component retainer for providing support to the electrical component.

2. The assembly of claim 1, wherein the electrical component comprises an electrical receptacle, the component retainer including a pair of clamping tabs laterally spanning the receptacle and a spring bias tab for urging the receptacle from between the clamping tabs.

3. The assembly of claim 1, wherein the bracket includes a central connector grasping portion and a pair of modular electrical component retaining tabs extending outwardly from one side of the central connector grasping portion for spanning and mechanically securing the electrical component.

4. The assembly of claim 3, wherein the bracket further includes a second pair of modular electrical component retaining tabs extending outwardly from a connector grasping portion side opposite said one side for spanning and mechanically securing a further electrical component whereby the cable and electrical connector may be located intermediate and sandwiched between the electrical components.

5. The assembly of claim 1, further including a relatively fixed structure and wherein the bracket includes a base portion for securing the bracket to the fixed structure.

6. The assembly of claim 5, wherein the base portion comprises a pair of flanges for spanning the fixed structure, each flange including a fastener receiving aperture.

7. A power distribution assembly including a multi conductor cable for supplying electrical energy to power utilization equipment, an electrical connector at one cable end, a jumper bracket mechanically directly supporting the cable end and corresponding connector, a power distribution block receiving the electrical connector, and a modular electrical component electrically connected to the power distribution block, the jumper bracket including a component retainer for directly mechanically engaging and supporting the electrical component.

8. The assembly of claim 7, further including a relatively fixed rigid support member, the bracket including a base portion having a pair of flanges for spanning and securing the bracket to the support member.

9. The assembly of claim 7, wherein the bracket includes a central connector grasping portion and a pair of modular electrical component retaining tabs extending outwardly from one side of the central connector grasping portion for spanning and mechanically securing the electrical component.

10. The assembly of claim 7, wherein the electrical component comprises an electrical receptacle.

11. The assembly of claim 10, wherein the component retainer includes a pair of clamping tabs laterally spanning the receptacle and a spring bias tab for urging the receptacle from between the clamping tabs.

12. A power distribution jumper assembly mounting bracket having a central jumper grasping portion and opposed pairs of modular electrical component retaining tabs, one pair of tabs extending outwardly from one side of the central jumper grasping portion and the other pair extending outwardly from an opposite side of the central jumper grasping portion for spanning and mechanically securing respective electrical components, each side of the central jumper grasping portion further including a resilient biasing portion for engaging and urging the corresponding electrical component outwardly away from the bracket to facilitate removal of the electrical component.

13. The assembly of claim 12, wherein the electrical components comprise electrical receptacles.

14. The assembly of claim 12, further comprising a base portion for securing the mounting bracket to a fixed structure.

15. The assembly of claim 14, wherein the base portion comprises a pair of flanges for spanning the fixed structure, each flange including a fastener receiving aperture.

16. A power distribution assembly including a relatively fixed rigid support member, a multiport electrical power distribution block mechanically coupled to the support member, an electrical component electrically connected to the power distribution block, a jumper cable electrically connected to the power distribution block, and a jumper mounting bracket extending from the support member and mechanically connected to and rigidly supporting both the electrical component and the cable the jumper cable.

17. The power distribution assembly of claim 16, wherein the jumper mounting bracket includes a central jumper grasping portion and opposed pairs of modular electrical component retaining tabs, one pair of tabs extending outwardly from one side of the central jumper grasping portion and the other pair extending outwardly from an opposite side of the central jumper grasping portion for spanning and mechanically securing respective electrical components, each side of the central jumper grasping portion further including a resilient biasing portion for engaging and urging the corresponding electrical component outwardly away from the bracket to facilitate removal of the electrical component.

18. The power distribution assembly of claim 17, further comprising a base portion including a pair of flanges for spanning the fixed rigid support member, each flange including a fastener receiving aperture for securing the mounting bracket to the fixed rigid support member.

19. The power distribution assembly of claim 17, wherein each side of the central jumper grasping portion further includes a resilient biasing portion for engaging and urging the corresponding electrical component outwardly away from the bracket to facilitate removal of the electrical component.

20. A method of assembling and stabilizing a power distribution system on a support member, comprising the steps of:

fixing a jumper mounting bracket to a cable and a connector of a jumper cable near one end of the jumper cable;

fastening a power distribution block to the support member;

electrically coupling the jumper cable one end and the power distribution block;

attaching the jumper mounting bracket to the support member;

electrically connecting a modular electrical component to the power distribution block; and mechanically connecting the modular electrical component to the jumper mounting bracket.

* * * * *

UNITED STATES PATENT AND TRADEMARK OFFICE

CERTIFICATE OF CORRECTION

PATENT NO. : 7,008,248 B2
APPLICATION NO. : 10/845695
DATED : March 7, 2006
INVENTOR(S) : Kondas et al.

It is certified that error appears in the above-identified patent and that said Letters Patent is hereby corrected as shown below:

COLUMN 6

Line 44, between “cable” and “the”, please insert --of--.

Signed and Sealed this

Fifth Day of December, 2006

JON W. DUDAS
*Director of the United States Patent and Trademark Office*